US008887479B2

(12) United States Patent
Koike et al.

(10) Patent No.: US 8,887,479 B2
(45) Date of Patent: Nov. 18, 2014

(54) MEDICINE PACKING UNIT AND PACKING CONTROL METHOD THEREOF

(75) Inventors: Naoki Koike, Toyonaka (JP); Masahiko Kasuya, Toyonaka (JP); Toru Tanaka, Toyonaka (JP); Tomonari Oda, Toyonaka (JP); Satoru Ogino, Toyonaka (JP)

(73) Assignee: Yuyama Mfg. Co., Ltd., Toyonaka-Shi (JP)

( * ) Notice: Subject to any disclaimer, the term of this patent is extended or adjusted under 35 U.S.C. 154(b) by 374 days.

(21) Appl. No.: 12/998,334

(22) PCT Filed: Oct. 9, 2009

(86) PCT No.: PCT/JP2009/067679

§ 371 (c)(1),
(2), (4) Date: Apr. 7, 2011

(87) PCT Pub. No.: WO2010/041751

PCT Pub. Date: Apr. 15, 2010

(65) Prior Publication Data

US 2011/0252750 A1 Oct. 20, 2011

(30) Foreign Application Priority Data

Oct. 9, 2008 (KR) ..... 10-2008-0099036

(51) Int. Cl.
*B65B 51/28* (2006.01)
*B65B 9/087* (2012.01)

(52) U.S. Cl.
CPC ..... *B65B 51/28* (2013.01); *B65B 9/087* (2013.01)
USPC ..... 53/479; 53/285

(58) Field of Classification Search
USPC ..... 53/550, 553, 562, 374.4, 75, 479
See application file for complete search history.

(56) References Cited

U.S. PATENT DOCUMENTS

| | | | | | |
|---|---|---|---|---|---|
| 4,897,985 | A * | 2/1990 | Buchko et al. | ..... | 53/559 |
| 5,722,215 | A * | 3/1998 | Yuyama | ..... | 53/374.4 |
| 5,875,610 | A * | 3/1999 | Yuyama et al. | ..... | 53/75 |
| 6,212,853 | B1 * | 4/2001 | Yuyama et al. | ..... | 53/66 |
| 6,301,862 | B1 * | 10/2001 | Yuyama et al. | ..... | 53/562 |

FOREIGN PATENT DOCUMENTS

| | | | | |
|---|---|---|---|---|
| JP | 62-39428 | | 2/1987 | |
| JP | 05-162706 | | 6/1993 | |
| JP | 05162706 | A * | 6/1993 | ..... B65B 9/06 |

* cited by examiner

*Primary Examiner* — Andrew M Tecco
(74) *Attorney, Agent, or Firm* — Masuvalley & Partners

(57) ABSTRACT

A medicament-packing unit contains a sheet feeder, a medicament-feeding hopper and a heat-sealing section. The sheet feeder feeds a packing sheet, folded into two in a longitudinal direction, to the heat-sealing section. The medicament-feeding hopper provides a medicament on the packing sheet fed by the sheet feeder. The heat-sealing section seals the packing sheet to pack the medicament provided on the packing sheet. The heat-sealing section contains a horizontal sealing roller, a first drive motor, a vertical sealing roller, a second drive motor, and a motor controller. The horizontal sealing roller seals the packing sheet in a horizontal direction. The first drive motor drives the horizontal sealing roller. The vertical sealing roller seals the packing sheet in a vertical direction. The second drive motor drives the vertical sealing roller. The motor controller controls the first drive motor and the second drive motor.

12 Claims, 8 Drawing Sheets

MEDICINE PACKING UNIT AND PACKING CONTROL METHOD THEREOF

TECHNICAL FIELD

The present invention relates to a medicament-packing machine. More specifically, the present invention relates to a medicament-packing unit located in the medicament-packing machine and a method of controlling the packing of medicaments such as tablets, powder and etc., using the medicament-packing unit.

BACKGROUND OF THE INVENTION

Various types of medicament-packing units, which pack a single dose of medicament based on a prescription, are widely used. One example is a unit configured to use a roll on which a narrow long packing sheet is folded into two in the longitudinal direction. In this unit, one dose of the medicament is introduced onto the packing sheet through a medicament feed hopper nozzle. The packing sheet is then sealed by heat rollers in the horizontal direction and vertical direction to pack the medicament. In a traditional machine, as shown in FIG. 7 and FIG. 8, it is necessary to control each sealing roller to carry out horizontal sealing 101 and vertical sealing 102 of a packing sheet 100. For this purpose, a horizontal roller is operated by one stepping motor to determine the length of one package. A vertical sealing roller is operated at a timing determined by software. The vertical sealing roller is controlled by the software while the horizontal sealing roller is simply operated. When both the horizontal sealing roller and the vertical sealing roller are needed to be driven together at a certain timing, an electromagnetic clutch is turned ON. If only the horizontal roller is driven, the electromagnetic clutch is turned OFF. Furthermore, motions of the heat rollers are controlled by turning ON/OFF of electromagnetic brakes. In such a traditional configuration, after the motion is completed by providing a certain constant pulse, the heat roller is stopped temporarily until the next signal. Due to this, the progress of packing is not smooth. Furthermore, when the powder dropped while the heat roller was stopped, the powder is blown up by the momentum caused by the drop and such blown powder 104 is trapped in the sealing portion of the package. This results in packing failure or quantity variation of one dose. Moreover, manufacturing costs are high to produce the traditional medicament-packing unit utilizing the stepping motors, the electromagnetic clutch and the electromagnetic brakes to control the rotation of the heat rollers.

SUMMARY OF THE INVENTION

The present invention resolves the above conventional drawbacks. The present invention provides a medicament-packing unit and a method of controlling packing thereof, in which a brushless motor is provided for each of the heat rollers for horizontal sealing and vertical sealing, in which the horizontal sealing roller is rotated continuously and the amount of rotation is monitored, and in which the vertical sealing roller is rotated or stopped when a desired amount of rotation of the horizontal sealing roller is achieved.

To solve the above problems, a medicament-packing unit of the present invention includes a sheet feeder, a medicament feeding hopper and a heat-sealing section. The sheet feeder feeds a packing sheet folded into two along its longitudinal direction. The medicament feeding hopper provides a medicament on the packing sheet, which is provided from the sheet feeder. The heat-sealing section seals the packing sheet for packing the medicament, which is provided on the packing sheet. The heat-sealing section contains a horizontal sealing roller, a first drive motor, a vertical sealing roller, a second drive motor and a drive motor controller. The horizontal sealing roller seals the packing sheet in a horizontal direction. The first drive motor drives the horizontal sealing roller. The vertical sealing roller seals the packing sheet in a vertical direction. The second drive motor drives the vertical sealing roller. The drive motor controller controls the drive motors. The first drive motor is maintained ON and continuously rotates the horizontal sealing roller. The vertical sealing roller is rotated with the horizontal sealing roller or stopped according to the amount of rotation of the horizontal sealing roller.

The first drive motor and the second drive motor may preferably be brushless drive motors.

The number of rotations of the horizontal roller and the vertical roller may be calculated by counting feedback pulses.

Another aspect of the present invention is a method of controlling packing a medicament, using a medicament-packing unit which includes a heat-sealing section containing brushless drive motors for driving a horizontal sealing roller and a vertical sealing roller, respectively. The method includes stages of a first stage, a second stage, a third stage, a fourth stage and a fifth stage. In the first stage, both the horizontal sealing roller and the vertical sealing roller are not driven. In the second stage, both the brushless motor for the horizontal sealing roller and the brushless motor for the vertical sealing roller are driven together until an amount of a rotation of the horizontal sealing roller reaches a first point. In the third stage, the brushless motor for the horizontal sealing roller is kept ON and the brushless motor for the vertical sealing roller is kept OFF until the amount of the rotation of the horizontal sealing roller reaches a second point. In the fourth stage, the brushless motor for the horizontal sealing roller is kept ON, and the brushless motor for the vertical sealing roller is also kept ON until the amount of the rotation of the horizontal sealing roller reaches a third point. In the fifth stage, the stage returns to the first stage if there is no subsequent work, or the stage repeats the second, third and fourth stages if there is a subsequent work.

The third stage may further include an action wherein a signal for clearing a deviation between the horizontal sealing roller and the vertical sealing roller is transmitted while the brushless motor for the vertical sealing roller is OFF.

In the traditional configuration, a constant pulse was provided. After the motion is completed, the heat roller was temporarily stopped until the next signal. However, according to the configuration of the present invention, the motor for the horizontal sealing roller continues to drive. If the next lot of medicament to be packed is provided and if it is determined to be ready to move to the next operation, the packing can be repeated by continuously rotating the heat roller. Blow-up of a powder medicament is reduced when the medicament falls on the moving packing sheet. Therefore, the powder medicament is effectively prevented from landing on the sealing portion. In addition, the amounts of a single dose between the packed medicaments become more consistent. And, packing failure is effectively prevented.

Furthermore, one configuration of the present invention utilizes two brushless motors as drive motors for heat rollers. This configuration reduces the costs compared to a conventional configuration employing stepping motors, an electromagnetic clutch and electromagnetic brakes.

DETAILED DESCRIPTION OF THE INVENTION

Figure 1:
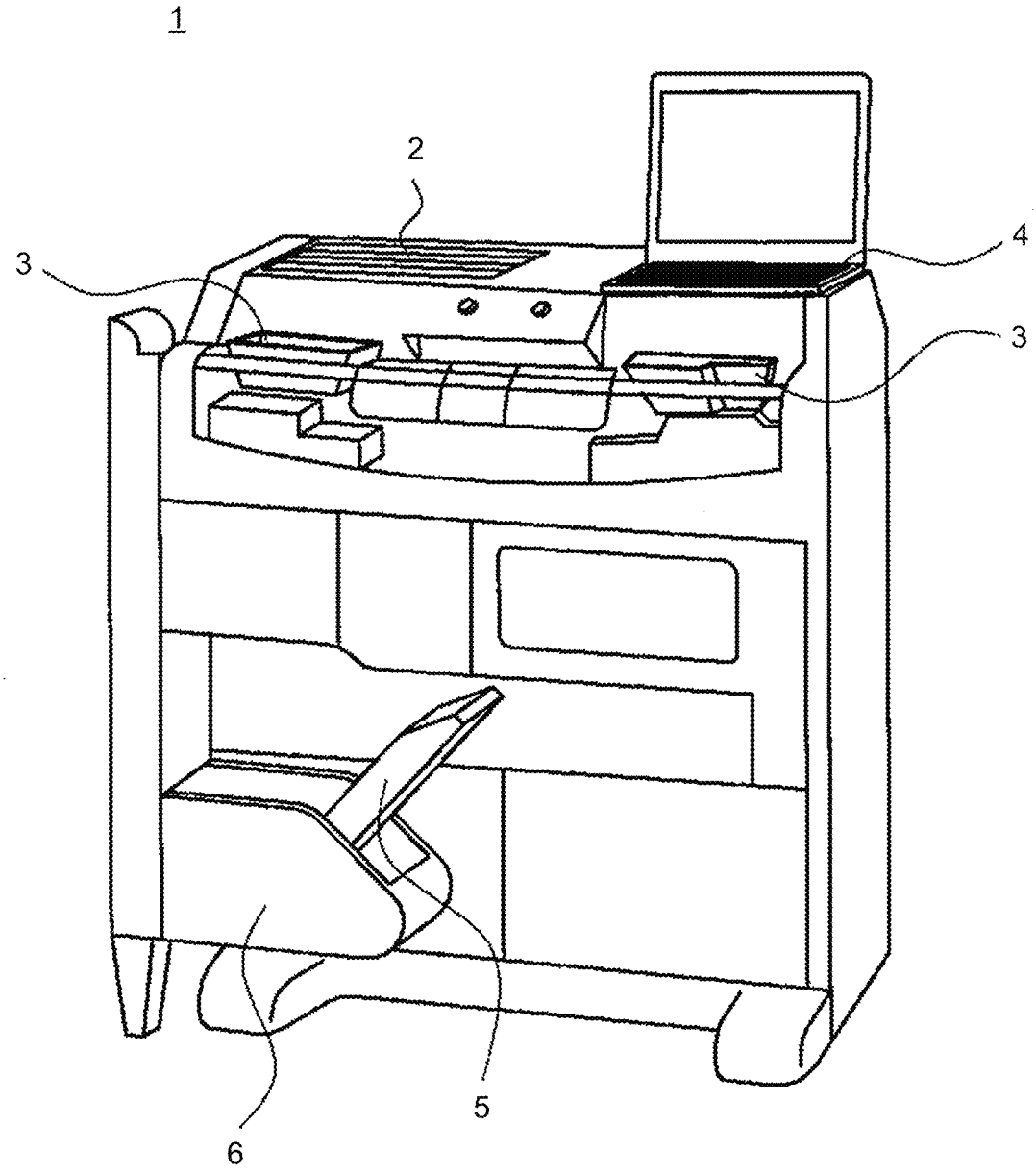
FIG. 1 is a perspective view of a medicament-packing machine of the embodiment.
Figure 2:
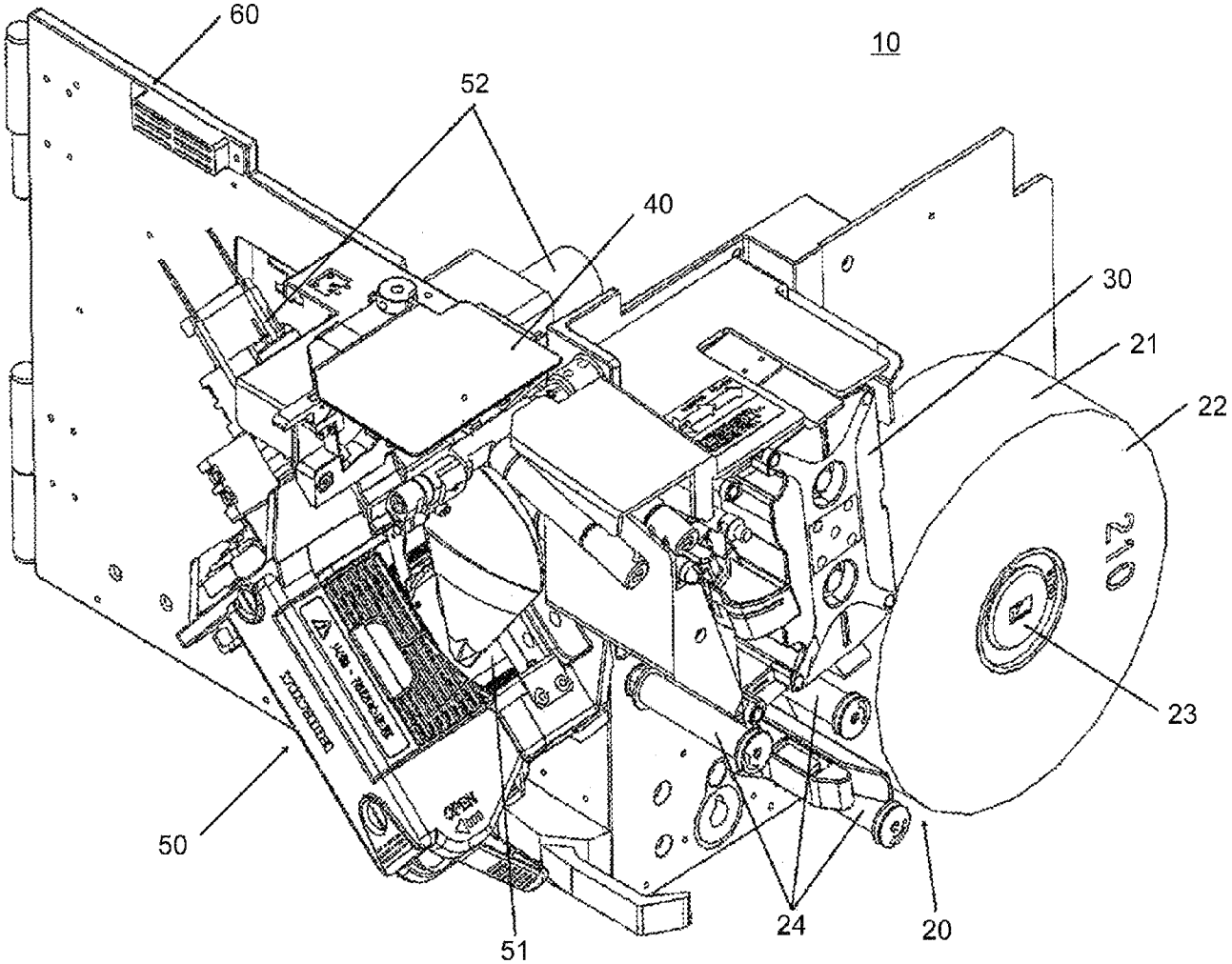
FIG. 2 is a perspective view of a medicament-packing unit located in the medicament-packing machine shown in FIG. 1.

Below, the embodiment of the present invention is explained, referring to the drawings. FIG. 1 shows a medicament-packing machine 1. The medicament-packing machine 1 is externally provided with a manual tablet dispensing apparatus 2, two hoppers 3 for feeding powder medicaments, a controlling device 4, a medicament discharging section 5 and a conveyor 6 for carrying the medicaments. Although not illustrated in the drawings, the medicament-packing machine 1 contains a disk and a scraper device internally. On the disk, a powder medicament provided through the hopper 3 is uniformly deposited. The scraper device scrapes out the medicament deposited on the disk. Furthermore, the medicament-packing machine 1 internally contains a medicament-packing unit 10 as shown in FIG. 2. This medicament-packing unit 10 packs the medicament scraped out by the scraper device into a pouch and discharges the pouched medicament to the medicament discharge section 5.

As shown in FIG. 2, the medicament-packing unit 10 has a sheet feeding section 20, an ink cartridge 30, a medicament-feeding hopper 40, and a heat-sealing section 50, all of which are mounted on a frame 60.

The sheet feeding unit 20 is composed of a roll shaft 23 and plural rollers 24. A narrow and long packing sheet 21 is folded into two in the longitudinal direction and is rolled to form a roll 22, which is attachable and detachable from the roll shaft 23. The rollers 24 change the direction of the packing sheet 21 drawn from the roll 22. The ink cartridge 30 prints information such as patient name, times to take and etc. on the packing sheet 21.

The medicament-feeding hopper 40 receives one-dose quantity of powder and tablets from the aforementioned scraper device (not shown in the figure) and the tablet dispensing apparatus 2. Then, the medicament-feeding hopper 40 introduces the medicament on the packing sheet 21 fed from the sheet feeding unit 20.

Figure 3:
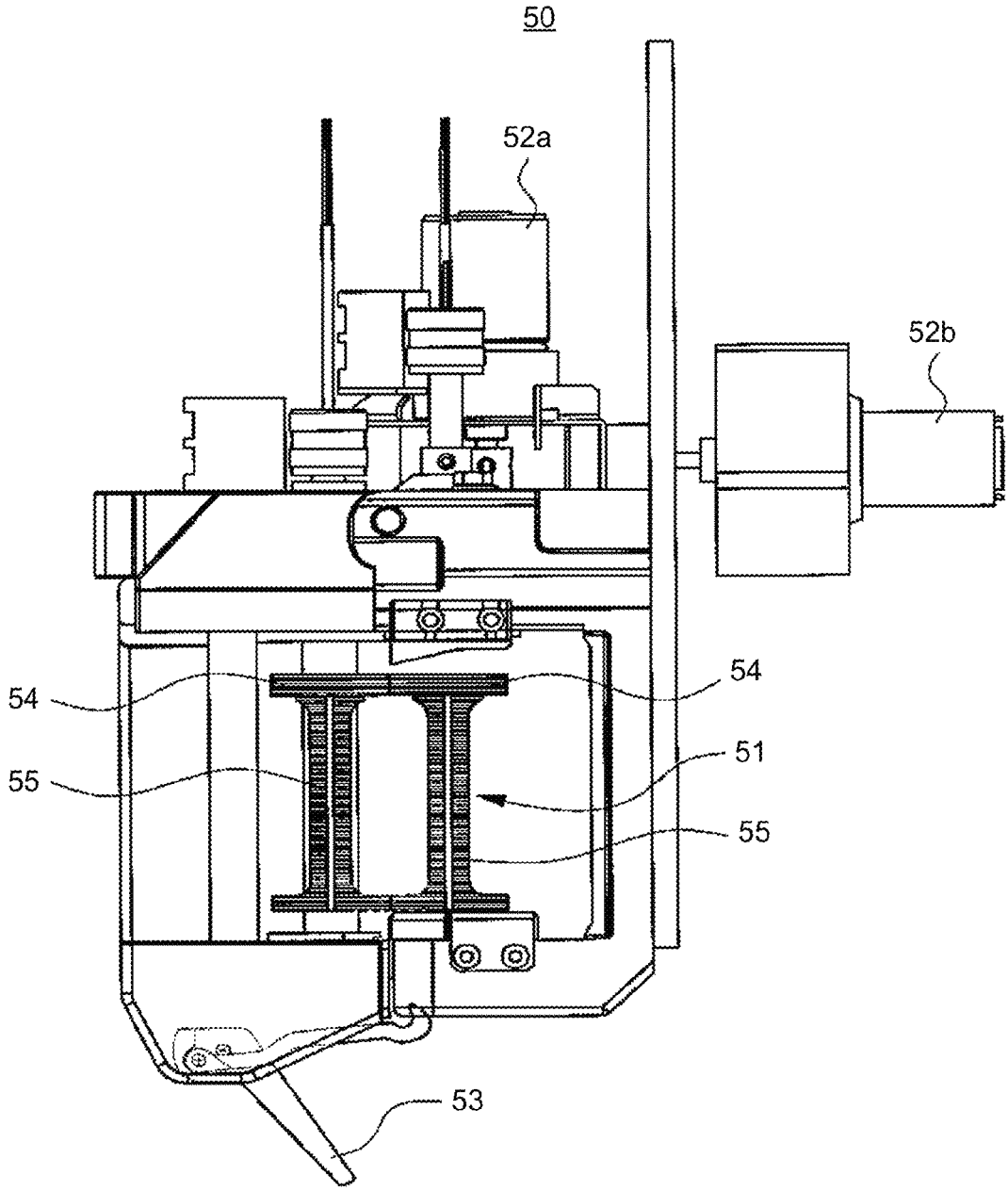
FIG. 3 is a front view of a heat-sealing section of the medicament-packing unit.

As shown in FIG. 3, the heat-sealing section 50, with its cover removed, includes heat rollers 51, brushless motors 52, and a bracket open/close lever 53. The heat rollers 51 perform horizontal and vertical sealing. The heat rollers 51 are composed of two pairs of a horizontal sealing roller 54 and a vertical sealing roller 55 that share a rotational axis and that can coordinate rotation with each other. The horizontal sealing rollers 54 seal a horizontal end of the packing sheet 21. The horizontal sealing rollers 54 have a short cylindrical shape and have a seal contact surface on their entire periphery. The pair of the horizontal sealing rollers 54 seals the packing sheet 21 horizontally while they rotate and engage with each other. The vertical sealing rollers 55 seal a vertical end of the packing sheet 21. The vertical sealing rollers 55 have an approximately square pillar shape and a height of the vertical sealing rollers 55 is larger than a height of the horizontal sealing rollers 54 in a direction of the rotational axis. The vertical sealing rollers 55 have a configuration such that two opposite sides of the four sides have a larger width and the other two opposite sides have a smaller width. Heat-sealing contact surfaces are provided only on the two narrower sides. The pair of the vertical sealing rollers 55 seals the packing sheet 21 vertically while one narrower side of one vertical sealing roller 55 and one narrower side of the other vertical sealing roller 55 contact each other after the vertical sealing rollers 55 rotate.

The heat-sealing section 50 also contains the brushless motors 52 that drive the heat rollers 51. The brushless motors 52 are composed of two drive motors that comprise a brushless motor 52*a* and a brushless motor 52*b*. The brushless motor 52*a* drives the horizontal sealing rollers 54 and the brushless motor 52*b* drives the vertical sealing rollers 55, respectively. Regarding the driving method of the brushless motors 52, as described later, the vertical sealing rollers 55 monitor the amount of rotation of the horizontal sealing rollers 54. When the amount of rotation of the horizontal sealing rollers 54 reaches a preset amount of rotation, the vertical sealing rollers 55 rotate or stop together while the horizontal sealing rollers 54 continue rotating. The amounts of rotations of the horizontal sealing rollers 54 and the vertical sealing rollers 55 are calculated by counting the numbers of feedback pulses transmitted from the horizontal sealing rollers 54 and the vertical sealing rollers 55. Accordingly, the horizontal sealing rollers 54 can be driven continuously without a need to stop. In addition, an electromagnetic clutch and electromagnetic brakes used in the traditional configuration are not necessary.

Figure 4:
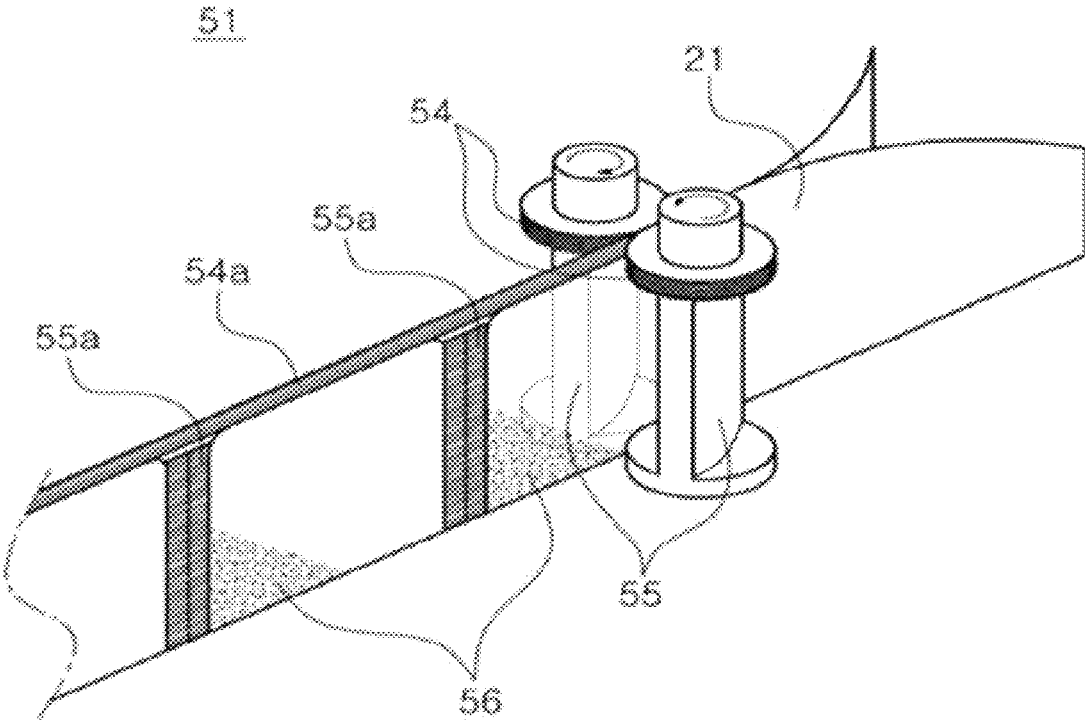
FIG. 4 is a diagram illustrating an operation of the heat-sealing section.

FIG. 4 illustrates an operation of the heat rollers 51. Once the heat rollers 51 rotate, a one-dose quantity of the medicament 56 fed to the medicament-feeding hopper 40 is provided between the folded packing sheet 21. Then, the packing sheet 21 is inserted between the heat rollers 51. Subsequently, a horizontal edge 54*a* of the packing sheet 21 is sealed by the rotation of the horizontal sealing rollers 54. Furthermore, a vertical edge 55*a* of the packing sheet 21 is sealed by the vertical sealing rollers 55, which rotate and stop based on the amount of rotation of the horizontal sealing rollers 54. Thereby, the medicament 56 is enclosed in the packing sheet 21, which is sealed at the horizontal seal section 54*a* and the vertical seal sections 55*a*. The medicament 56 sealed in the packing sheet 21 is discharged from the medicament discharge section 5 and transported by the conveyor 6.

Figure 5:
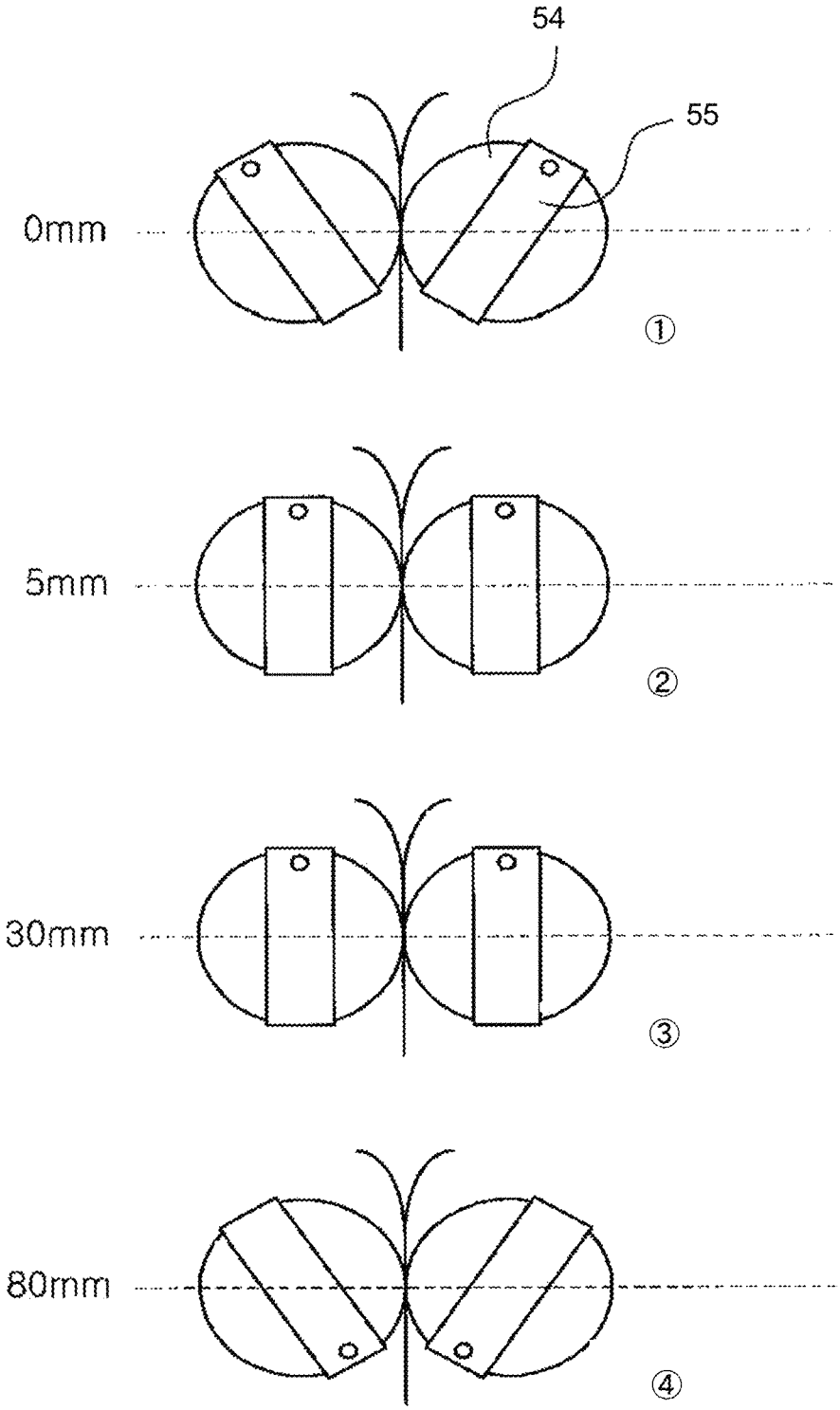
FIG. 5 is a diagram illustrating a method of controlling packing by the heat-sealing section.
Figure 6:
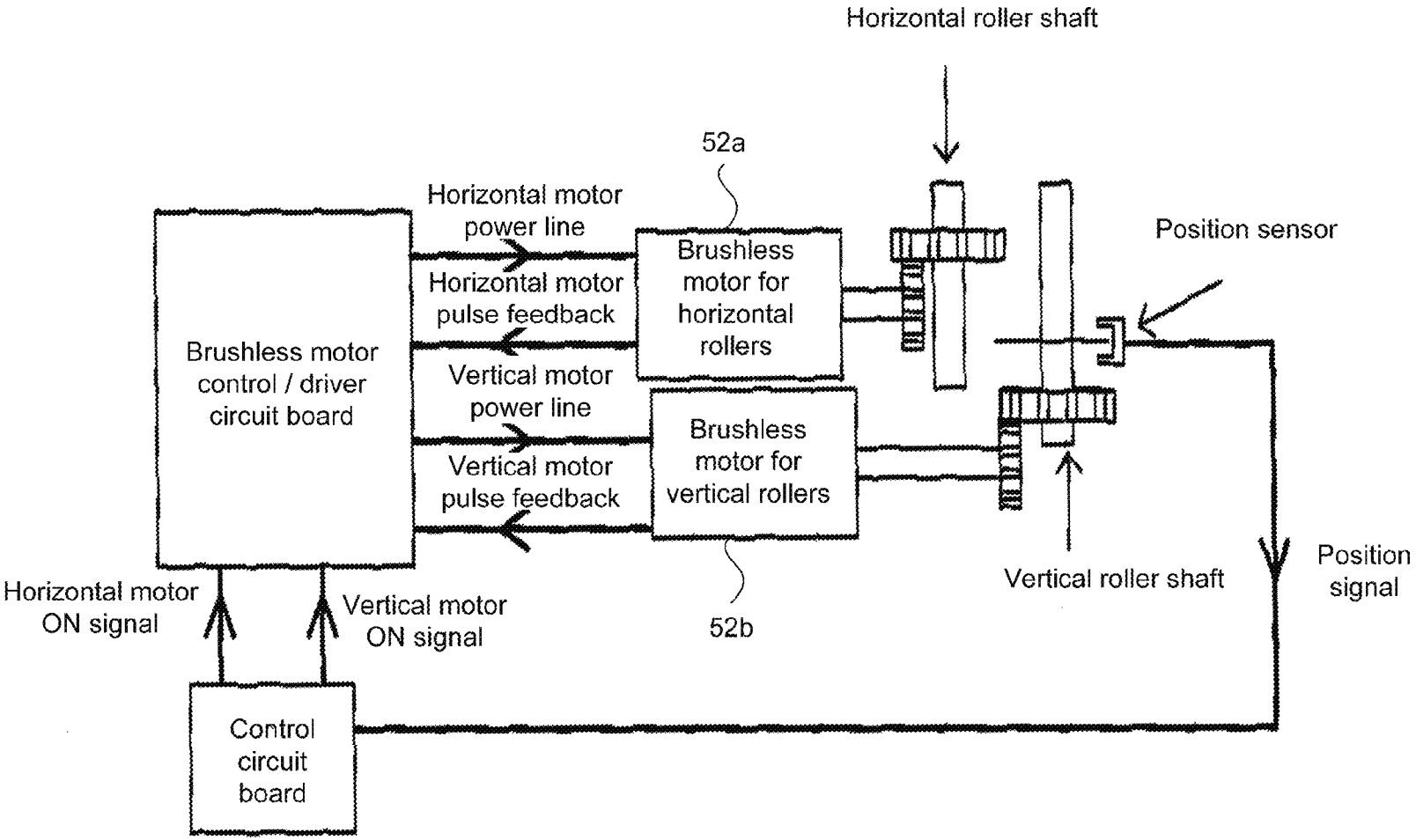
FIG. 6 PRIOR ART
FIG. 6 shows a configuration of the heat-sealing section.
Figure 7:
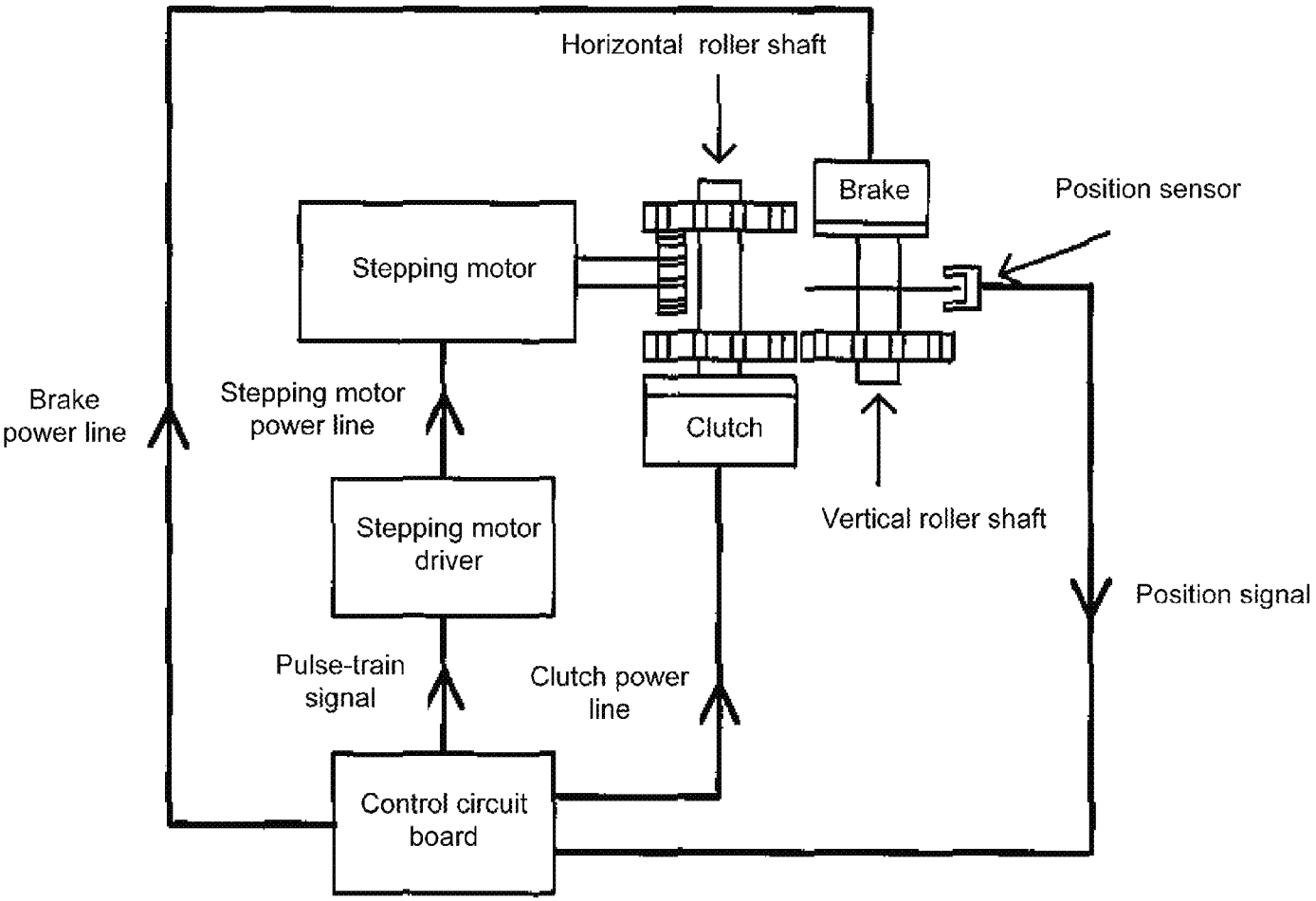
FIG. 7 PRIOR ART
FIG. 7 shows a configuration of a heat-sealing section of a traditional medicament-packing unit.
Figure 8:
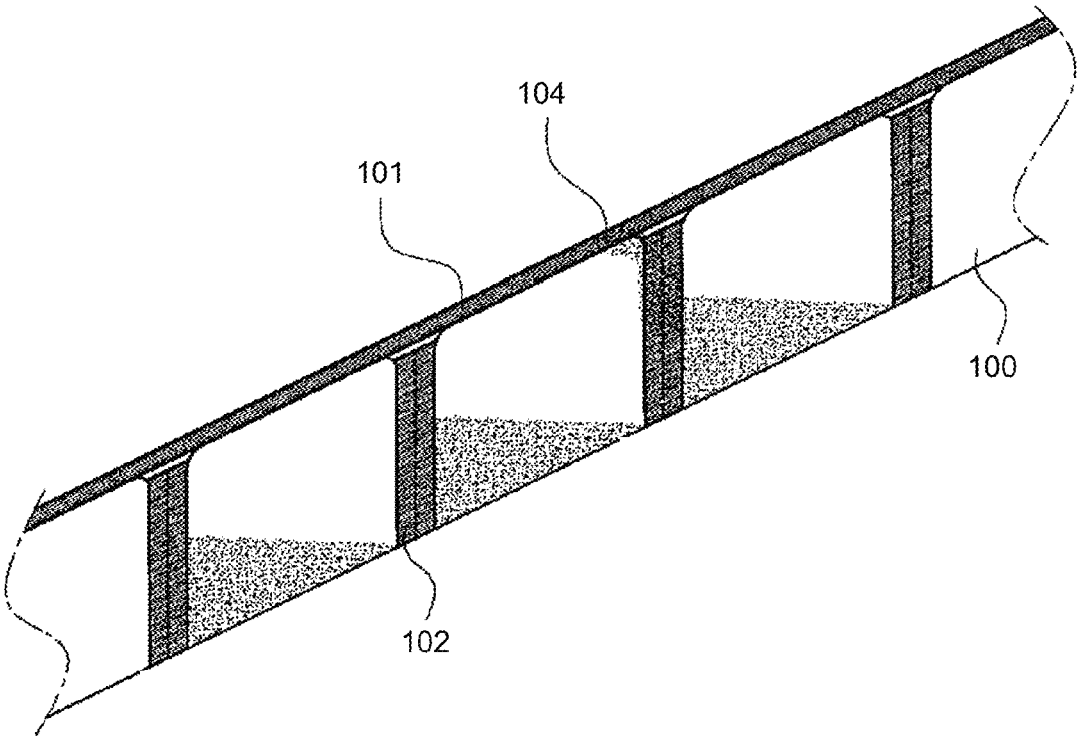
FIG. 8 is a perspective view of a packing sheet packed by the heat-sealing section of the traditional medicament-packing unit.

Next, a method of controlling the medicament-packing unit of the present invention is explained, referring to FIG. 5 and FIG. 6.

FIG. 5 illustrates a method of controlling the medicament-packing unit in a chronological order to pack the medicament. FIG. 6 is a schematic block diagram showing a control and signal transmission system of the heat-sealing section 50.

First, regarding the size of the medicament pouch, although various horizontal widths such as 60 mm, 70 mm, 76 mm, 80 mm, 90 mm and etc. are used, any desired horizontal width can be set based on the amount of rotation of the horizontal sealing rollers 54. In other words, the amount of rotation of the horizontal rollers 54 is adjusted based on the horizontal width of the pouch. In this example, the method of controlling the medicament-packing unit for packing the medicament is explained assuming a pouch having an 80 mm width.

(0) WAIT stage: At this stage, both the brushless motors 52*a* and 52*b* are OFF. Thus, both the horizontal sealing rollers 54 and the vertical sealing rollers 55 are not driven and are at a waiting state. The WAIT stage provides a start position where an operation of packing a medicament into one pouch is initiated.

(1) First spot reach stage: Both the brushless motor 52*a* and the brushless motor 52*b* are turned ON, and the horizontal sealing rollers 54 and the vertical sealing rollers 55 begin to rotate together. At the same time, a feedback pulse counter is cleared, and the feedback pulse counter starts counting the numbers of the feedback pulses. By counting the numbers of feedback pulses, the amounts of rotations of the horizontal sealing rollers 54 and the vertical sealing rollers 55 are monitored. In this stage, both the horizontal sealing rollers 54 and the vertical sealing rollers 55 rotate together until the amount of rotation of the horizontal sealing roller 54 reaches 5 mm.

(2) Second spot reach stage: Once the horizontal sealing rollers 54 reach the first spot, the operation shifts to a second spot reach stage, in which the horizontal sealing rollers 54 rotate until the total amount of rotation of the horizontal sealing roller 54 reaches 30 mm. In the second spot reach stage, only the brushless motor 52*a* is maintained ON while the brushless motor 52*b* is maintained OFF. In other words, while the horizontal sealing rollers 54 rotate by 25 mm in this stage, the vertical sealing rollers 55 are stopped. While the vertical sealing rollers 55 are OFF, a deviation clearing signal for clearing the deviation between the horizontal sealing rollers 54 and the vertical sealing rollers 55 is transmitted. This is because the medicament-packing unit 10 is configured such that the vertical sealing rollers 55 pursue the horizontal sealing rollers 54 and a deviation is produced between them. The deviation clearing signal clears such a deviation. Therefore, in this stage, the deviation between the horizontal sealing rollers 54 and the vertical sealing rollers 55 is cleared. In other words, from the view point of operation, a start time of the brushless motor 52*b* is generated by the clearance of the deviation.

(3) Third spot reach stage: When the horizontal sealing rollers 54 reach the second spot, the operation proceeds to a third spot reach stage, in which the horizontal sealing rollers 54 rotate until the total amount of rotation of the horizontal sealing roller 54 reaches 80 mm. In the third spot reach stage, the brushless motor 52*a* is maintained ON, and the brushless motor 52*b*, which has been OFF in the second spot reach stage and whose deviation was cleared, is turned ON. By this arrangement, both the horizontal sealing rollers 54 and the vertical sealing rollers 55 rotate together by 50 mm. In other words, both the horizontal sealing rollers 54 and the vertical sealing rollers 55 keep rotating until the total amount of rotation of the horizontal sealing roller 54 reaches 80 mm.

(4) Determination stage: When the horizontal sealing rollers 54 reach the third spot, it is determined if there is a subsequent work requirement of another sealing. If there is no such requirement, the operation goes back to the WAIT stage explained above. If there is a subsequent work requirement, the operation immediately proceeds to the first spot reach stage explained above. Therefore, as long as there is a requirement for a new sealing, the horizontal sealing rollers 54 do not stop and continue rotating. On the other hand, the vertical sealing rollers 55 at one time rotate together with the horizontal sealing rollers 54 and at one time stop based on the amount of rotation of the horizontal sealing roller 54. Thereby, the operation of the heat rollers is done smoothly and seamlessly. In addition, when the powder drops and hits the packing sheet 21, the falling momentum of the powder is reduced, and the blowup of the powder is effectively prevented.

What is claimed is:

1. A method of packing a medicament, utilizing a medicament-packing unit comprising a first brushless motor for driving a horizontal sealing roller and a second brushless motor for driving a vertical sealing roller, the method comprising the steps of:

a first step wherein both the first brushless motor and the second brushless motor are OFF;

a second step wherein the first brushless motor drives the horizontal sealing roller and the second brushless motor drives the vertical sealing roller until an amount of rotation of the horizontal sealing roller reaches a first amount;

a third step wherein the first brushless motor continues driving the horizontal sealing roller and the second brushless motor is OFF until the amount of rotation of the horizontal sealing roller reaches a second amount;

a fourth step wherein the first brushless motor continues driving the horizontal sealing roller and the second brushless motor drives the vertical sealing roller until the amount of rotation of the horizontal sealing roller reaches a third amount; and a fifth step wherein a subsequent packing work requirement is determined, wherein a step returns to the first step if there is no subsequent packing work requirement and wherein the second, third and fourth steps are repeated if there is a subsequent packing work requirement;

wherein in the third step, a signal to clear a deviation between the horizontal sealing roller and the vertical sealing roller is transmitted while the second brushless motor is OFF.

2. The method of claim 1, further comprising:

a sheet feeder that feeds a packing sheet;

a hopper that provides a one-dose amount of the medicament on the packing sheet; and the horizontal sealing roller that seals a first part of the packing sheet in a longitudinal direction of the packing sheet; and the vertical sealing roller that seals a second part of the packing sheet in a transverse direction of the packing sheet;

wherein the horizontal sealing roller continuously rotates while the medicament-packing unit is packing a batch of the medicaments in the packing sheet; and wherein the vertical sealing roller rotates until an amount of rotation of the horizontal sealing roller reaches a preset amount and the vertical sealing roller stops after the amount of rotation of the horizontal sealing roller reaches the preset amount.

3. The medicament-packing unit of claim 2, wherein the vertical sealing roller resumes rotating when the amount of rotation of the horizontal sealing roller reaches a second preset amount.

4. The medicament-packing unit of claim 2, wherein the amount of rotation of the horizontal sealing roller is obtained by counting a number of feedback pulses transmitted from the horizontal sealing roller.

5. The medicament-packing unit of claim 2, wherein a rotational axis of the second roller corresponds to a rotational axis of the horizontal sealing roller.

6. The medicament-packing unit of claim 2, wherein a height of the horizontal sealing roller is smaller than a height of the second roller.

7. The medicament-packing unit of claim 2, wherein an entire periphery of the horizontal sealing roller is heated to seal the first part of the packing sheet; and wherein a part of periphery of the vertical sealing roller is heated to seal the second part of the packing sheet.

8. The medicament-packing unit of claim 7, wherein the vertical sealing roller has at least two sides on a periphery of the vertical sealing roller;

wherein one side of the periphery is narrower than the other side of the periphery; and wherein the narrower side of the periphery is heated to seal the second part of the packing sheet.

9. A method of packing a medicament, utilizing a medicament-packing unit comprising a first brushless motor for driving a horizontal sealing roller and a second brushless motor for driving a vertical sealing roller, the method comprising the steps of:

a first step wherein both the first brushless motor and the second brushless motor are OFF;

a second step wherein the first brushless motor drives the horizontal sealing roller and the second brushless motor drives the vertical sealing roller until an amount of rotation of the horizontal sealing roller reaches a first amount;

a third step wherein the first brushless motor continues driving the horizontal sealing roller and the second brushless motor is OFF until the amount of rotation of the horizontal sealing roller reaches a second amount;

a fourth step wherein the first brushless motor continues driving the horizontal sealing roller and the second brushless motor drives the vertical sealing roller until the amount of rotation of the horizontal sealing roller reaches a third amount; and a fifth step wherein a subsequent packing work requirement is determined, wherein a step becomes the first step if there is no subsequent packing work requirement and wherein the second, third and fourth steps are repeated if there is a subsequent packing work requirement; wherein in the third step, a signal to clear a deviation between the horizontal sealing roller and the vertical sealing roller is transmitted while the second brushless motor is OFF;

wherein a number of feedback pulses transmitted from the horizontal sealing roller is counted to monitor the amount of rotations of the horizontal sealing roller.

10. The method of claim 9, further comprising:

a sheet feeder for feeding a packing sheet folded into two in a longitudinal direction;

a medicament-feeding hopper for providing a medicament on the packing sheet fed by the sheet feeder; and a heat-sealing section for sealing the packing sheet to pack the medicament provided on the packing sheet, the heat-sealing section comprising:

the horizontal sealing roller that seals the packing sheet in a horizontal direction;

the first brushless motor that drives the horizontal sealing roller;

the vertical sealing roller that seals the packing sheet in a vertical direction;

the second brushless motor that drives the vertical sealing roller; and a motor controller that controls the first drive motor and the second drive motor;

wherein the first brushless motor is maintained ON and the horizontal sealing roller continuously rotates; and wherein the vertical sealing roller rotates with the horizontal sealing roller or stops based on an amount of rotation of the horizontal sealing roller.

11. A method of packing a medicament, utilizing a medicament-packing unit comprising a first brushless motor for driving a horizontal sealing roller and a second brushless motor for driving a vertical sealing roller, the method comprising the steps of:

a first step wherein both the first brushless motor and the second brushless motor are OFF;

a second step wherein the first brushless motor drives the horizontal sealing roller and the second brushless motor drives the vertical sealing roller until an amount of rotation of the horizontal sealing roller reaches a first amount;

a third step wherein the first brushless motor continues driving the horizontal sealing roller and the second brushless motor is OFF until the amount of rotation of the horizontal sealing roller reaches a second amount; and a fourth step wherein a subsequent packing work requirement is determined, wherein a step returns to the first step if there is no subsequent packing work requirement and wherein the first, second and third steps are repeated if there is a subsequent packing work requirement;

wherein in the third step, a signal to clear a deviation between the horizontal sealing roller and the vertical sealing roller is transmitted while the second brushless motor is OFF.

12. The method of claim 11, wherein a number of feedback pulses transmitted from the horizontal sealing roller is counted to monitor the amount of rotations of the horizontal sealing roller.

* * * * *